US006402075B1

(12) United States Patent
Grimes

(10) Patent No.: US 6,402,075 B1
(45) Date of Patent: Jun. 11, 2002

(54) STRING CONTROL SYSTEM

(76) Inventor: Edward Grimes, 191 Jewell St., Columbus, IN (US) 47203

( * ) Notice: Subject to any disclaimer, the term of this patent is extended or adjusted under 35 U.S.C. 154(b) by 0 days.

(21) Appl. No.: 09/572,879

(22) Filed: May 19, 2000

(51) Int. Cl.[7] ..... B65H 75/40

(52) U.S. Cl. ..... 242/395; 242/405.3; 242/407; 242/614; 244/155 A

(58) Field of Search ..... 242/395, 395.1, 242/405, 405.3, 407, 614, 614.1; 244/155 A; D8/359

(56) References Cited

U.S. PATENT DOCUMENTS

| | | | | | |
|---|---|---|---|---|---|
| 104,495 | A | * | 6/1870 | Pugh | 242/405.3 |
| 591,290 | A | * | 10/1897 | Noll | 242/395 |
| 610,494 | A | * | 9/1898 | Nelson | 242/395 |
| 779,245 | A | * | 1/1905 | Stark | 242/407 |
| 836,444 | A | * | 11/1906 | Goldenberg | 242/395 |
| 850,236 | A | * | 4/1907 | Maguire | 242/407 |
| 1,784,064 | A | * | 12/1930 | Griswold | 242/405 |
| 2,585,263 | A | * | 2/1952 | Miller | 242/407 |
| D182,753 | S | * | 5/1958 | Allen | 242/395 |
| D231,763 | S | | 6/1974 | Smith | |
| 4,106,719 | A | * | 8/1978 | Haverland | 242/405.3 |
| 4,176,807 | A | | 12/1979 | Kwon | |
| 4,238,086 | A | | 12/1980 | Brimmeier | |
| 4,747,561 | A | | 5/1988 | Sweeney et al. | |
| 4,796,827 | A | | 1/1989 | Munt, III et al. | |
| 5,238,201 | A | | 8/1993 | Jonushaitis | |

* cited by examiner

*Primary Examiner*—John M. Jillions

(57) ABSTRACT

A string control system for conveniently dispensing for use and retracting for storage an elongate flexible member. The string control system includes a reeling device for dispensing an elongate flexible member during use of the flexible member and retracting the flexible member for storage of the flexible member. The device comprises a frame having laterally spaced side portions and longitudinally spaced end portions defining an opening. The end portions extend between the side portions. A spool is provided for winding a length of an elongate flexible member thereon. The spool is positioned in the opening of the frame and is rotatably mounted on the frame. The spool has a pair of flange portions and a central portion mounted between the flange portions. A crank is provided for rotating the spool. Preferably, each of the flange portions of the spool has a hub and at least two guide spokes extending radially outward from the hub.

18 Claims, 2 Drawing Sheets

STRING CONTROL SYSTEM

BACKGROUND OF THE INVENTION

1. Field of the Invention

The present invention relates to string storage devices and more particularly pertains to a new string control system for conveniently dispensing for use and retracting for storage an elongate flexible member.

2. Description of the Prior Art

The use of string storage devices is known in the prior art. More specifically, string storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,176,807; U.S. Pat. No. 4,238,086; U.S. Pat. No. 4,747,561; U.S. Pat. No. 4,796,827; U.S. Pat. No. 5,238,201; and U.S. Pat. No. Des. 281,763.

The string control system according to the present invention substantially departs from the conventional concepts and designs of the prior art, and in so doing provides an apparatus primarily developed for the purpose of conveniently dispensing for use and retracting for storage an elongate flexible member.

SUMMARY OF THE INVENTION

In view of the foregoing disadvantages inherent in the known types of string storage devices now present in the prior art, the present invention provides a new string control system construction wherein the same can be utilized for conveniently dispensing for use and retracting for storage an elongate flexible member.

The general purpose of the present invention, which will be described subsequently in greater detail, is to provide a new string control system apparatus and method which has many of the advantages of the string storage devices mentioned heretofore and many novel features that result in a new string control system which is not anticipated, rendered obvious, suggested, or even implied by any of the prior art string storage devices, either alone or in any combination thereof.

To attain this, the present invention generally comprises a reeling device for dispensing an elongate flexible member during use of the flexible member and retracting the flexible member for storage of the flexible member. The device comprises a frame having laterally spaced side portions and longitudinally spaced end portions defining an opening. The end portions extend between the side portions. A spool is provided for winding a length of an elongate flexible member thereon. The spool is positioned in the opening of the frame and is rotatably mounted on the frame. The spool has a pair of flange portions and a central portion mounted between the flange portions. A crank is provided for rotating the spool. Preferably, each of the flange portions of the spool has a hub and at least two guide spokes extending radially outward from the hub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new string control system apparatus and method which has many of the advantages of the string storage devices mentioned heretofore and many novel features that result in a new string control system which is not anticipated, rendered obvious, suggested, or even implied by any of the prior art string storage devices, either alone or in any combination thereof.

It is another object of the present invention to provide a new string control system which may be easily and efficiently manufactured and marketed.

It is a further object of the present invention to provide a new string control system which is of a durable and reliable construction.

An even further object of the present invention is to provide a new string control system which is susceptible of a low cost of manufacture with regard to both materials and labor, and which accordingly is then susceptible of low prices of sale to the consuming public, thereby making such string control system economically available to the buying public.

Still yet another object of the present invention is to provide a new string control system which provides in the apparatuses and methods of the prior art some of the advantages thereof, while simultaneously overcoming some of the disadvantages normally associated therewith.

Still another object of the present invention is to provide a new string control system for conveniently dispensing for use and retracting for storage an elongate flexible member.

Yet another object of the present invention is to provide a new string control system which includes a reeling device for dispensing an elongate flexible member during use of the flexible member and retracting the flexible member for storage of the flexible member. The device comprises a frame having laterally spaced side portions and longitudinally spaced end portions defining an opening. The end portions extend between the side portions. A spool is provided for winding a length of an elongate flexible member thereon. The spool is positioned in the opening of the frame and is rotatably mounted on the frame. The spool has a pair of flange portions and a central portion mounted between the flange portions. A crank is provided for rotating the spool. Preferably, each of the flange portions of the spool has a hub and at least two guide spokes extending radially outward from the hub.

Still yet another object of the present invention is to provide a new string control system that provides easy and accurate control of the extension and retraction of the elongate flexible member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
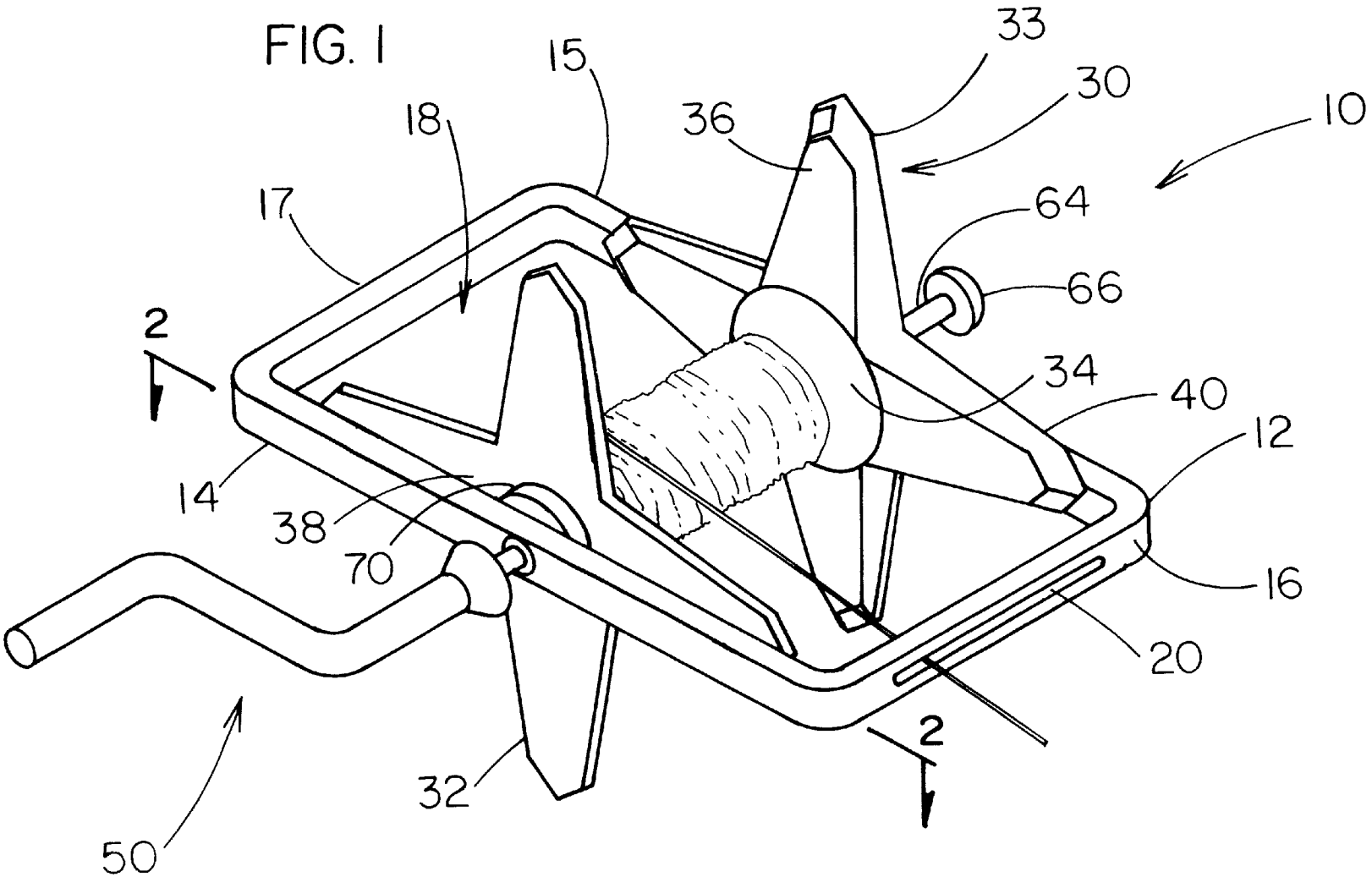
FIG. 1 is a schematic perspective view of a new string control system according to the present invention with the handle and axle shown in a partially exploded condition from the frame and spool.
Figure 2:
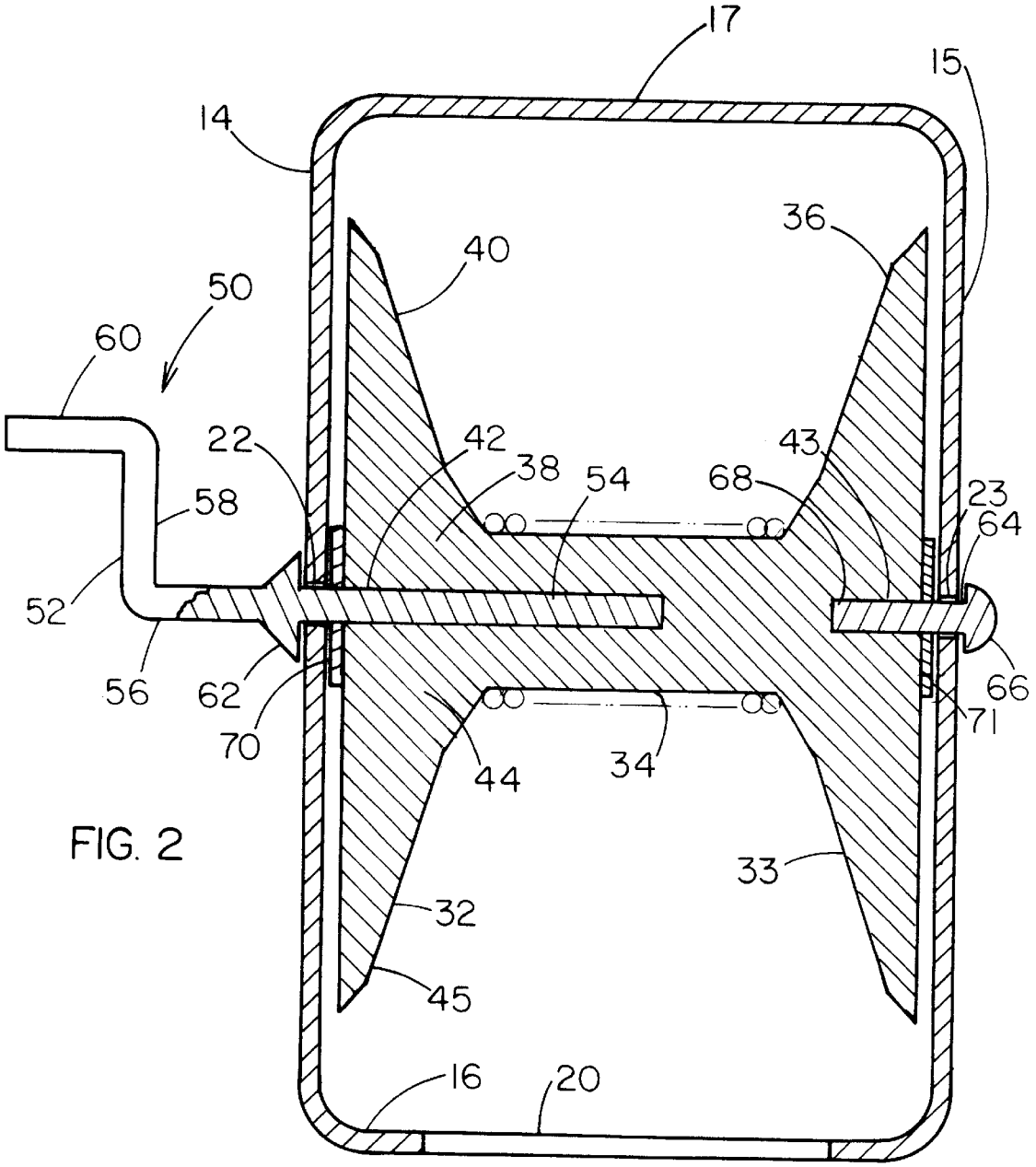
FIG. 2 is a schematic sectional view of the present invention taken along line 2—2 of FIG. 1.

With reference now to the drawings, and in particular to FIGS. 1 and 2 thereof, a new string control system embodying the principles and concepts of the present invention and generally designated by the reference numeral 10 will be described.

As best illustrated in FIGS. 1 and 2, the string control system generally comprises a reeling device 10 for dispensing an elongate flexible member 2 during use of the flexible member and retracting the flexible member for storage of the flexible member. The elongate flexible member may comprise any type of line, string, cord, rope, twine, cable, and the like, especially those forms suitable for use with a kite.

The device generally includes a frame 12, a spool 30 mounted on the frame, and a crank 50 for rotating the spool with respect to the frame.

The frame 12 has laterally spaced side portions 14, 15 and longitudinally spaced end portions 16, 17 defining an opening 18. The end portions extend between and connect the side portions. The side portions may be oriented substantially parallel and the end portions may be oriented substantially parallel, such that the frame is substantially rectangular. The portions of the frame may preferably have a uniform width and thickness at substantially all locations of the frame. A first one 16 of the end portions has a slot 20 therethrough for extending a portion of an elongate flexible member 2 therethrough. A second one 17 of the end portions is adapted to be gripped by a hand of a user such that the hand of the user is positioned opposite of the slot 20 and the exit point of the flexible member from the reeling device. When the frame is held by the end portion 17, the frame (and the slot) of the device is held in alignment with the flexible member, which reduces the pressure placed on the flexible member at the slot 20 and thus can reduce wear on the flexible member. Each of the side portions has an axle hole 22, 23 therethrough, with each of the axle holes preferably being located substantially centrally between the end portions.

The spool 30 is provided for coiling a length of an elongate flexible member thereabout. The spool is rotatably mounted on the frame for winding and unwinding the flexible member on the spool. The spool has a pair of flange portions 32, 33 and a central portion 34 mounted between the flange portions. Each of the flange portions may have a guide surface 36 extending at an obtuse angle with respect to a longitudinal axis of the central portion for guiding the flexible member toward the central portion 34.

Each of the flange portions has a hub 38 and at least two guide spokes 40 extending radially outward from the hub. The hub 38 of each flange portions has a channel 42, 43 extending into the flange portion. The channels of the flange portions are axially aligned with each other.

Each of the guide spokes 40 has a base end 44 and a free end 45. The guide spoke has a width and a length, with the width of the guide spoke preferably tapering narrower from the base end to the free end. In the most preferred embodiment of the invention, each of the flange portions has four guide spokes extending at substantially uniform circumferential spacings on the hub. Preferably, the width of the guide spoke is approximately equal to the side portion of the frame such that a user may easily hold the guide spoke and the side member in an adjacent condition for selectively preventing rotation of the spool with respect to the frame. As the free ends of the spokes are not connected to each other, such as by an annular ring, the user's hand may easily grip and release the spokes.

The crank 50 is provided for rotating the spool. The crank has a handle portion 52 and an axle portion 54. One embodiment of the handle portion 52 has a central section 56, an offset section 58, and a gripping section 60. The central section 56 and the gripping section 60 may be oriented substantially parallel to each other. The offset section 58 may be oriented substantially perpendicular to the central section 56 and offsets the gripping section from the central section. The axle portion 54 of the crank extends from the central section. A collar 62 may be positioned between the central section and the axle portion of the crank. The axle portion of the crank extends through one of the holes in the frame and into the channel of one of the hubs of the spool. The axle portion 54 of the crank is fixedly connected to the channel, such as by, for example, bonding the axle portion 54 to the channel of the spool.

The invention may also include a stub axle 64 which extends through one of the holes of the frame and into the channel of one of the hubs of the spool. The stub axle 64 has a head portion 66 and an axle portion 68, with the axle portion 68 being inserted in the channel of one of the hubs of the spool. The axle portion 68 of the stub axle is fixedly connected to the channel, such as by, for example, bonding the axle portion 68 to the channel of the spool.

The invention may also include a spacer 70, 71 positioned between each of the hubs of the spool and the frame. A first one 70 of the spacers has the axle portion 68 of the stub axle extending through an aperture in the spacer, and a second one 71 of the spacers has the axle portion 54 of the crank extending through an aperture in the spacer.

In use, a length of the elongate flexible member is wound about the central portion of the spool, and a free end of the flexible member is threaded through the slot in the frame. The free end may be connected to a kite, and the reeling device of the invention may be held by the end portion of the frame that is located opposite of the end portion with the slot through which the elongate member extends. The spool may be allowed to free wheel as the flexible member pays out, or the handle of the crank may be slowly rotated to unwind the flexible member, thus controlling the rate of pay out. Once the desired extent of flexible member has been payed out, the handle of the crank can be held against rotation by the user's hand, or the user may hold one of the spokes of the spool in a position adjacent to one of the side portions of the frame. Optionally, the user may grip one of the side portions of the frame such that the movement of the spokes past the side portion of the frame is blocked by the gripping hand, or the user's hand may grip directly on one of the spokes to prevent rotation. Optionally, the user may hold the frame between a hand of the user and the user's stomach. When it is desired to retract the flexible member back onto the spool, the handle portion of the crank is rotated in a direction opposite from the direction rotated during the paying out of the flexible member.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reeling device for dispensing an elongate flexible member during use of the flexible member and retracting the flexible member for storage of the flexible member, the device comprising:

a frame having laterally spaced side portions and longitudinally spaced end portions defining an opening, the end portions extending between the side portions;

a spool for winding a length of an elongate flexible member thereon, the spool being positioned in the opening of the frame and being rotatably mounted on the frame, the spool having a pair of flange portions and a central portion mounted between the flange portions; and a crank for rotating the spool;

wherein each of the flange portions of the spool has a hub and at least two guide spokes extending radially outward from the hub;

wherein each of the flange portions of the spool has a guide surface, a portion of the guide surface on the hub extending along a line oriented at a first obtuse angle with respect to a longitudinal axis of the central portion for guiding the flexible member toward the central portion, a portion of the guide surface on the guide spokes extending along a line oriented at a second obtuse angle with respect to the longitudinal axis of the central portion for guiding the flexible member inwardly toward the portion of the guide surface on the hub, the second obtuse angle having a greater degree measurement than a degree measurement of the first obtuseangle.

2. The reeling device of claim 1 wherein the hub of each flange portions of the spool has a channel extending into the flange portion, the channels of the flange portions being axially aligned with each other.

3. The reeling device of claim 1 wherein each of the guide spokes of the spool has a base end and a free end, the guide spoke having a width and a length, the width of the guide spoke tapering narrower from the base end to the free end.

4. The reeling device of claim 1 wherein each of the flange portions of the spool includes four guide spokes.

5. The reeling device of claim 1 wherein the crank has a handle portion and an axle portion, the handle portion having a central section, an offset section, and a gripping section, the central section and the gripping section being oriented substantially parallel to each other.

6. The reeling device of claim 5 wherein the offset section of the handle portion is oriented substantially perpendicular to the central section.

7. The reeling device of claim 5 wherein the axle portion of the crank extends from the central section, and wherein the axle portion of the crank extends through one of the holes in the frame and into the channel of one of the hubs of the spool.

8. The reeling device of claim 7 wherein the axle portion of the crank is bonded to the channel of the spool.

9. The reeling device of claim 5 wherein a collar is positioned between the central section and the axle portion of the crank.

10. The reeling device of claim 1 additionally comprising a stub axle extending through a hole on one of the side portions of the frame and into a channel of one of the flange portions of the spool.

11. The reeling device of claim 10 wherein the stub axle has a head portion and an axle portion, the axle portion being inserted in the channel.

12. The reeling device of claim 11 wherein the axle portion of the stub axle is bonded to the channel.

13. The reeling device of claim 1 additionally comprising a spacer positioned between each of the flange portions of the spool and the frame, a first one of the spacers having an axle portion of a stub axle extending through an aperture in the spacer, a second one of the spacers having an axle portion of the crank extending through an aperture in the spacer.

14. The reeling device of claim 1 wherein the side portions of the frame are substantially parallel and the end portions are substantially parallel such that the frame is substantially rectangular.

15. The reeling device of claim 1 wherein the frame has a uniform width and thickness at substantially all locations of the frame.

16. The reeling device of claim 1 wherein a first one of the end portions of the frame has a slot therethrough for extending a portion of an elongate flexible member therethrough, a second one of the end portions being adapted to be gripped by a hand of a user.

17. The reeling device of claim 1 wherein each of the side portions of the frame has an axle hole therethrough, each of the axle holes being located substantially centrally between the end portions.

18. A reeling device for dispensing an elongate flexible member during use of the flexible member and retracting the flexible member for storage of the flexible member, the device comprising:

a frame having laterally spaced side portions and longitudinally spaced end portions defining an opening, the end portions extending between the side portions, wherein the side portions are substantially parallel and the end portions being substantially parallel, the frame being substantially rectangular, wherein the frame has a uniform width and thickness at substantially all locations of the frame, wherein a first one of the end portions having a slot therethrough for extending a portion of an elongate flexible member therethrough, a second one of the end portions being adapted to be gripped by a hand of a user, and wherein each of the side portions has an axle hole therethrough, each of the axle holes being located substantially centrally between the end portions;

a spool for winding a length of an elongate flexible member thereon, the spool being rotatably mounted on the frame, the spool having a pair of flange portions and a central portion mounted between the flange portions, each of the flange portions having a hub and a guide spoke extending radially outward from the hub, each of the flange portions of the spool having a guide surface, a portion of the guide surface on the hub extending along a line oriented at a first obtuse angle with respect to a longitudinal axis of the central portion for guiding the flexible member toward the central portion, a portion of the guide surface on the guide spokes extending along a line oriented at a second obtuse angle with respect to the longitudinal axis of the central portion for guiding the flexible member inwardly toward the portion of the guide surface on the hub, the second obtuse angle having a greater degree measurement than a degree measurement of the first obtuse angle, the hub of each flange portion having a channel extending into the flange portion, the channels of the flange portions being axially aligned with each other, wherein each of the guide spokes has a base end and a free end, the guide spoke having a width and a length, the width of the guide spoke tapering narrower from the base end to the free end, and wherein each of the flange portions has four guide spokes;

a crank for rotating the spool, the crank having a handle portion and an axle portion, the handle portion having a central section, an offset section, and a gripping section, the central section and the gripping section being oriented substantially parallel to each other, the offset section being oriented substantially perpendicular to the central section, the axle portion extending from the central section, a collar being positioned between the central section and the axle portion of the crank, wherein the axle portion of the crank extends through one of the holes in the frame and into the channel of one of the hubs of the spool, the axle portion of the crank being bonded to the channel of the spool;

a stub axle extending through one of the holes of the frame and into the channel of one of the hubs of the spool, the stub axle having a head portion and an axle portion, the axle portion being inserted in the channel, the axle portion being bonded to the channel; and a spacer positioned between each of the hubs of the spool and the frame, a first one of the spacers having the axle portion of the stub axle extending through an aperture in the spacer, a second one of the spacers having the axle portion of the crank extending through an aperture in the spacer.

* * * * *